US006406130B1

(12) United States Patent
Gooray et al.

(10) Patent No.: US 6,406,130 B1
(45) Date of Patent: Jun. 18, 2002

(54) FLUID EJECTION SYSTEMS AND METHODS WITH SECONDARY DIELECTRIC FLUID

(75) Inventors: Arthur M. Gooray; George J. Roller, both of Penfield, NY (US); Joseph M. Crowley, Morgan Hill, CA (US); Paul C. Galambos; Frank J. Peter, both of Albuquerque, NM (US); Kevin R. Zavadil, Bernilillo, NM (US); Richard C. Givler, Albuquerque, NM (US); Leonard M. Carreira, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/785,160

(22) Filed: Feb. 20, 2001

(51) Int. Cl.[7] ..... B41J 2/04
(52) U.S. Cl. ..... 347/54
(58) Field of Search ..... 347/54, 68, 69, 347/70, 71, 50, 40, 74, 77, 76, 49, 73; 399/261; 361/700; 29/890.1; 310/328–330

(56) References Cited

U.S. PATENT DOCUMENTS

| | | | |
|---|---|---|---|
| 4,520,375 | A | 5/1985 | Kroll |
| 5,501,893 | A | 3/1996 | Laermer et al. |
| 5,668,579 | A | 9/1997 | Fujii et al. |
| 5,754,205 | A | 5/1998 | Miyata et al. |
| 5,783,340 | A | 7/1998 | Farino et al. |
| 5,798,283 | A | 8/1998 | Montague et al. |
| 5,804,084 | A | 9/1998 | Nasby et al. |
| 5,821,951 | A | 10/1998 | Fujii et al. |
| 5,828,394 | A | 10/1998 | Khuri-Yakub et al. |
| 5,919,548 | A | 7/1999 | Barron et al. |
| 5,963,788 | A | 10/1999 | Barron et al. |
| 6,082,208 | A | 7/2000 | Rodgers et al. |
| 6,127,198 | A | 10/2000 | Coleman et al. |

OTHER PUBLICATIONS

U.S. patent application Ser. No. 09/718,480, Arthur M. Gooray et al., filed Nov. 24, 2000.
U.S. patent application Ser. No. 09/723,243, Arthur M. Gooray et al., filed Nov. 28, 2000.

*Primary Examiner*—Raquel Yvette Gordon
(74) *Attorney, Agent, or Firm*—Oliff & Berridge, PLC

(57) ABSTRACT

A fluid ejection system according to this invention operates on the principle of electrostatic or magnetic attraction. In various exemplary embodiments, the fluid ejection system includes a sealed diaphragm arrangement having at least one diaphragm portion and a diaphragm chamber defined at least partially by the at least one diaphragm portion, a nozzle hole located over the at least one diaphragm portion, an ejection chamber defined between the nozzle hole and the least one diaphragm portion and a secondary dielectric fluid reservoir containing a secondary dielectric fluid. The ejection chamber receives a primary fluid to be ejected. The secondary dielectric fluid reservoir is in fluid communication with the diaphragm chamber to supply the secondary dielectric fluid to the diaphragm chamber. In various exemplary embodiments, the secondary dielectric fluid is a liquid, a substantially incompressible fluid, and/or a high performance dielectric fluid having a dielectric constant greater than 1.

16 Claims, 4 Drawing Sheets

FLUID EJECTION SYSTEMS AND METHODS WITH SECONDARY DIELECTRIC FLUID

BACKGROUND OF THE INVENTION

1. Field of Invention

This invention relates to micromachined or microelectromechanical system based fluid ejectors and fluid ejection methods.

2. Description of Related Art

Fluid ejectors have been developed for inkjet recording or printing. Ink jet recording apparatus offer numerous benefits, including extremely quiet operation when recording, high speed printing, a high degree of freedom in ink selection, and the ability to use low-cost plain paper. The so-called "drop-on-demand" drive method, where ink is output only when required for recording, is now the conventional approach. The drop-on-demand drive method makes it unnecessary to recover ink not needed for recording.

Fluid ejectors for inkjet printing include one or more nozzles which allow the formation and control of small ink droplets to permit high resolution, resulting in the ability to print sharper characters with improved tonal resolution. In particular, drop-on-demand inkjet print heads are generally used for high resolution printers.

Drop-on-demand technology generally uses some type of pulse generator to form and eject drops. For example, in one type of print head, a chamber having an ink nozzle may be fitted with a piezoelectric wall that is deformed when a voltage is applied. As a result of the deformation, the fluid is forced out of the nozzle orifice as a drop. The drop then impinges directly on an associated printing surface. Use of such a piezoelectric device as a driver is described in JP B-1990-51734.

Another type of print head uses bubbles formed by heat pulses to force fluid out of the nozzle. The drops are separated from the ink supply when the bubbles form. Use of pressure generated by heating the ink to generate bubbles is described in JP B-1986-59911.

Yet another type of drop-on-demand print head incorporates an electrostatic actuator. This type of print head utilizes electrostatic force to eject the ink. Examples of such electrostatic print heads are disclosed in U.S. Pat. No. 4,520,375 to Kroll and Japanese Laid-Open Patent Publication No. 289351/90. The inkjet head disclosed in the 375 patent uses an electrostatic actuator comprising a diaphragm that constitutes a part of an ink ejection chamber and a base plate disposed outside of the ink ejection chamber opposite to the diaphragm. The ink jet head ejects ink droplets through a nozzle communicating with the ink ejection chamber, by applying a time varying voltage between the diaphragm and the base plate. The diaphragm and the base plate thus act as a capacitor, which causes the diaphragm to be set into mechanical motion and the fluid to exit responsive to the diaphragm's motion. On the other hand, the ink jet head discussed in the Japan 351 distorts its diaphragm by applying a voltage to an electrostatic actuator fixed on the diaphragm. This result in suction of ink into an ink ejection chamber. Once the voltage is removed, the diaphragm is restored to its non-distorted condition, ejecting ink from the ink ejection chamber.

Fluid drop ejectors maybe used not only for printing, but also for depositing photoresist and other liquids in the semiconductor and flat panel display industries, for delivering drug and biological samples, for delivering multiple chemicals for chemical reactions, for handling DNA sequences, for delivering drugs and biological materials for interaction studies and assaying, and for depositing thin and narrow layers of plastics for usable as permanent and/or removable gaskets in micro-machines.

SUMMARY OF THE INVENTION

The systems and methods of this invention provide increased electrostatic force for fluid ejection in an electrostatic fluid ejector.

The systems and methods of this invention separately provide greater fluid ejection efficiency.

The systems and methods of this invention separately provide greater fluid ejection velocity with an electrostatic fluid ejector.

The systems and methods of this invention separately provide for compensation within a sealed chamber of a secondary dielectric fluid.

The systems and methods of this invention separately provide an actively powered ejection cycle for ejecting fluid from a fluid ejector.

The systems and methods of this invention separately provide increased force on a fluid over the cycle of a fluid ejector.

The systems and methods of this invention separately provide isolation of the electrostatic field from the primary fluid or fluid to be ejected.

The systems and methods of this invention separately provide increased latitude in primary fluid design.

The systems and methods of this invention separately utilize a high performance secondary dielectric fluid.

According to various exemplary embodiments of the systems and methods of this invention, a sealed diaphragm that is used to eject a fluid from a fluid ejector that contains a secondary dielectric fluid. According to other various exemplary embodiments, the secondary dielectric fluid is a liquid. According to other various exemplary embodiments, the secondary dielectric fluid is substantially incompressible. According to various other exemplary embodiments, the secondary dielectric fluid is a high performance dielectric fluid or dielectrically enhanced fluid.

According to various exemplary embodiments of the systems and methods of this invention, a sealed diaphragm chamber is connected to a secondary dielectric reservoir. According to other various exemplary embodiments of the systems and methods of this invention, a secondary dielectric feed hole is formed through a substrate to be in communication with the diaphragm chamber. According to further various exemplary embodiments of the systems and methods of this invention, a channel is formed to be in communication with the sealed diaphragm chamber. According to various exemplary embodiments of the systems and methods of this invention, a fluid ejection system comprises a containment structure for a fluid to be ejected, an electrode and a sealed diaphragm that at least partly defines a chamber in which a secondary dielectric fluid is provided.

According to various exemplary embodiments of the systems and methods of this invention, a fluid ejection system comprises a sealed diaphragm arrangement including at least one diaphragm portion and a diaphragm chamber defined at least partially by the at least one diaphragm portion. A nozzle hole is located over the at least one diaphragm portion. An ejection chamber that receives a primary fluid to be ejected is defined between the nozzle hole and the least one diaphragm portion. A secondary dielectric fluid reservoir containing a secondary dielectric fluid is in fluid communication with the diaphragm chamber to supply the secondary dielectric fluid to the diaphragm chamber.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and methods of this invention described in detail below, with reference to the attached drawing figures, in which.

DETAILED DESCRIPTION OF EXEMPLARY EMBODIMENTS

Figure 1:
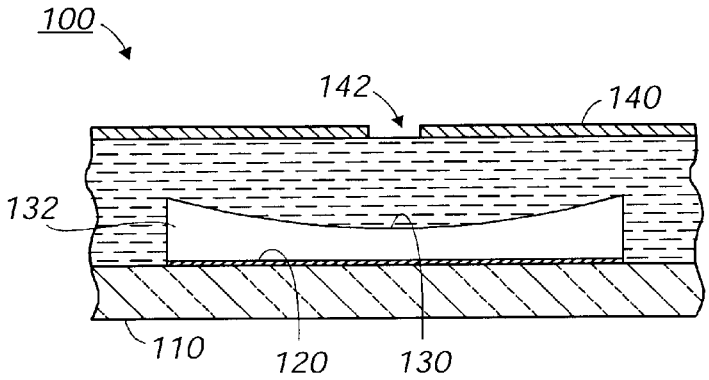
FIG. 1 is a cross-sectional view of an exemplary embodiment of a single fluid ejector using a sealed diaphragm in a state where the diaphragm is deflected.

A fluid ejection system according to this invention operates on the principle of electrostatic or magnetic attraction. In various exemplary embodiments, the fluid ejection system includes a sealed diaphragm arrangement having at least one diaphragm portion and a diaphragm chamber defined at least partially by the at least one diaphragm portion, a nozzle hole located over the at least one diaphragm portion, an ejection chamber defined between the nozzle hole and the least one diaphragm portion and a secondary dielectric fluid reservoir containing a secondary dielectric fluid. The ejection chamber receives a primary fluid to be ejected, which may or may not be a dielectric fluid. The secondary dielectric fluid reservoir is in fluid communication with the diaphragm chamber to supply the secondary dielectric fluid to the diaphragm chamber. In various exemplary embodiments, the secondary dielectric fluid is a liquid, a substantially incompressible fluid, and/or a high performance dielectric fluid and/or dielectrically enhanced fluid having a dielectric constant greater than 1. The use of a secondary dielectric fluid reservoir containing a secondary dielectric fluid provides a fluid ejection system with improved performance, particularly when the secondary dielectric fluid is a high performance dielectric fluid having a dielectric constant greater than 1.

In various exemplary embodiments, the fluid ejection system includes an electrode arrangement that causes the diaphragm portion to deflect when a drive signal is applied to at least one electrode of the electrode arrangement to generate an electrostatic field between the at least one electrode and the diaphragm portion. The diaphragm portion is attracted towards the at least one electrode by an electrostatic force of the generated electrostatic field.

As the diaphragm portion is deflected, the secondary dielectric fluid supplied to the diaphragm chamber is allowed to flow into or out of the secondary dielectric fluid reservoir. Thus, the electrostatic force need not compress or expand the volume of the secondary dielectric fluid in the diaphragm chamber to deflect the diaphragm portion. Accordingly, substantially incompressible fluids and/or high performance dielectric fluids having a dielectric constant greater than 1 may be advantageously used for the secondary dielectric fluid.

Since the electrostatic field is not across the ejection fluid, an increased variety of ejection fluid designs mat be employed, such as polar, non-polar, conductive or non-conductive.

If the electrode is situated so that the diaphragm portion deflects into the ejection chamber defined between the nozzle hole and the diaphragm portion, a drop of fluid is ejected through the nozzle hole when the diaphragm portion deflects. After a drop is ejected, the movement of the diaphragm portion is reversed, either through normal resilient restoration actions of the deformed diaphragm portion or through an applied force. The reversed movement of the diaphragm portion may be used to refill the ejection chamber with fluid to be ejected.

If the electrode is situated so that the diaphragm portion deflects away from the ejection chamber, fluid is overfilled in the ejection chamber when the diaphragm portion deflects. When the drive signal applied to the electrode is removed, the movement of the diaphragm portion is reversed, either through normal resilient restoration actions of the deformed diaphragm portion or through an applied force, to eject a drop of fluid.

The fluid ejection systems of this invention may be easily produced via monolithic batch fabrication based on the common production technique of silicon-based surface micro-machining and would have the potential for very low cost of production, high reliability and "on demand" drop size modulation. However, while the following discussion of the systems and methods of this invention may refer to aspects specific to silicon based surface micromachining, in fact other materials and production techniques for the fluid ejection systems of this invention are possible. Also, the systems and methods of the invention may be utilized in any mechanical configuration of such an ejector (e.g., "roof shooter" or "edge shooter") and in any size array of ejectors.

Figure 2:
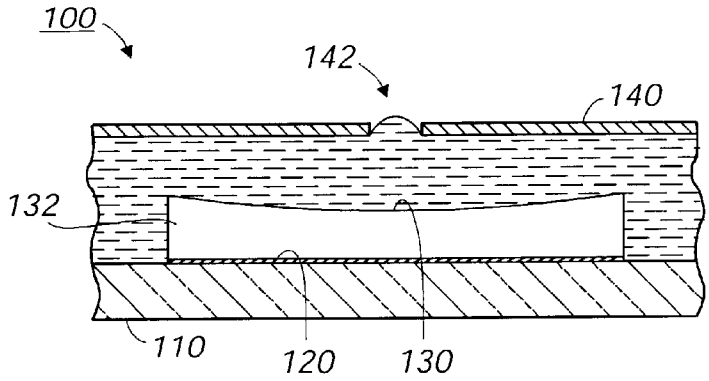
FIG. 2 is a cross-sectional view of the single fluid ejector of FIG. 1 in a state where the diaphragm is ejecting a drop of fluid.
Figure 3:
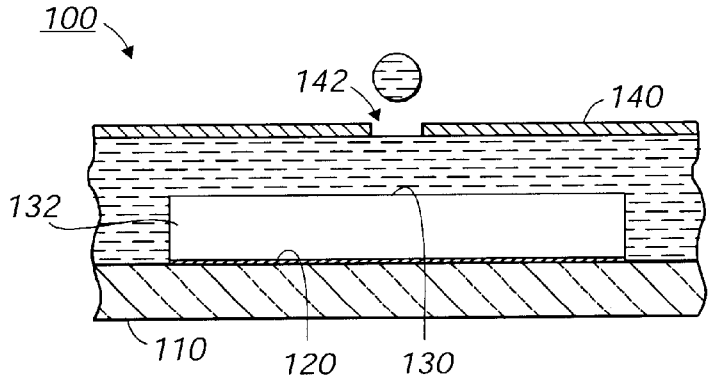
FIG. 3 is a cross-sectional view of the single fluid ejector of FIG. 1 in a state where the diaphragm is at rest.

FIGS. 1–3 show a simplified illustration of a single ejector in a "roof shooter" configuration is shown in FIGS. 1–3. As shown in FIG. 1, the ejector 100 includes a base plate 110, an electrode 120, a diaphragm 130 and a faceplate 140 with a nozzle hole 142. A diaphragm chamber 132 is sealed from the fluid to be ejected by the diaphragm 130. In this example, air is contained in the diaphragm chamber 132.

FIG. 3 shows an initial state of operation with the diaphragm 130 in an undeflected state. As shown in FIG. 1, as an electrostatic field is generated across the air gap between the electrode 120 and the diaphragm 130, the diaphragm 130 is deflected into a deflected state. As the diaphragm 130 is deflected, fluid is drawn into the space created by the deflected diaphragm 130 from a reservoir, which may be located at any part of the periphery of the ejector 100.

Assuming a uniform applied electrostatic force across the diaphragm 130, the relationships may be approximated as follows:

$$F=(\kappa\in_0 A)(E^2)/2 \quad (1)$$

where:

κ is the relative permitivity ($=\in/\in_0$) also called dielectric constant, of the fluid;

$\in_0$ is the permitivity of free space (i.e., vacuum),;

A is the cross sectional area of the electrode; and

E is the electrostatic field strength.

This may be recast as an applied pressure as follows:

$$P=(\kappa\in_0)(E^2)/2. \quad (2)$$

For a circular diaphragm of diameter "d" (radius "r"), the maximum deflection occurring at the center of the diaphragm is approximately:

$$\delta=(Pr^4)/(64D); \quad (3)$$

where:

$D=(Et^3)/(12(1-u^2))$;

E is Young's Modulus;

t is the diaphragm thickness; and u is Poisson's ratio.

In actuality, as the diaphragm 130 deflects, the center of the diaphragm 130 will experience an electrostatic field, and hence a force, which is different than that experienced by the periphery of the diaphragm 130. These relationships, however, serve to illustrate the basic approach.

When the fluid is to be ejected, the electrostatic field is removed so that the resilient restoration force of the diaphragm 130 causes the diaphragm 130 to return to its undeflected state shown in FIG. 3. FIG. 2 shows an intermediate non-static state between the deflected and undeflected states shown in FIGS. 1 and 3, respectively. The resilient restoration force is transferred to the fluid, causing some fluid to be forced back into the reservoir and some fluid to be ejected through the nozzle hole 142, as shown in FIG. 3. This action is somewhat analogous to a "cocked" spring. The percentage of the fluid which is expelled as a drop, relative to the amount of fluid being moved by the diaphragm 130, may be controlled through specific design parameters of the ejector 100. Such parameters include the size of the diaphragm 130, the applied force, the distance between the diaphragm 130 and the faceplate 140 and other unique dimensions and features that may help govern flow, such as, for example, incorporating valves into the ejector 100. This volumetric efficiency can be enhanced by optimizing the "cocked" geometry of the diaphragm.

As seen from the equations governing the deflection of the diaphragm 130, a key parameter limiting the available force exerted on the fluid during ejection is the dielectric constant of the compressible fluid in the diaphragm chamber 132. In this case, air has a dielectric constant of approximately 1. While using air as the working dielectric may offer simplified manufacturing, doing so may limit the overall performance of the ejector 100. For example, a much higher voltage is required to deflect the diaphragm, which may result in increased power dissipation in the ejector 100.

Various exemplary embodiments of the systems and methods of this invention overcome such drawbacks. In a first exemplary embodiment of the fluid ejection systems according to this invention, shown in FIGS. 4–7, a fluid ejector 200 has a sealed diaphragm arrangement comprising a diaphragm portion 230 and a diaphragm chamber 232. In this exemplary embodiment, the diaphragm chamber 232 contains an incompressible secondary dielectric fluid 234.

In the exemplary embodiment shown in FIGS. 4–7, the sealed diaphragm arrangement is formed on a substrate 210. An electrode 220 is situated on the substrate 210 opposite the diaphragm portion 230. A faceplate 240 with a nozzle hole 242 is situated on a side of the diaphragm portion 230 opposite the substrate 210.

Figure 4:
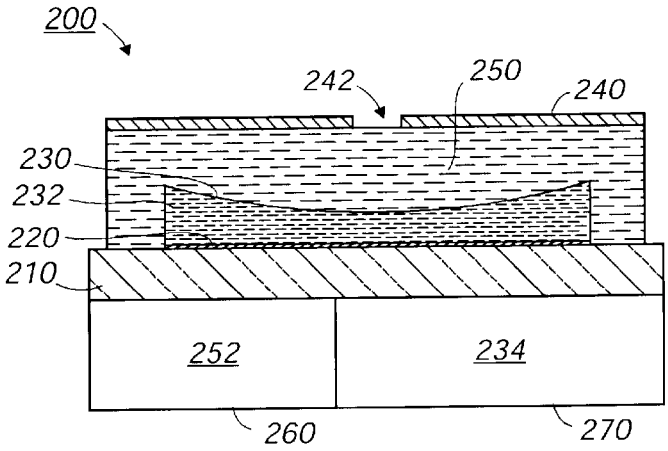
FIG. 4 is a cross-sectional view of a first exemplary embodiment of a fluid ejector according to this invention, using a secondary dielectric fluid with a sealed diaphragm, in a state where the diaphragm is deflected.
Figure 5:
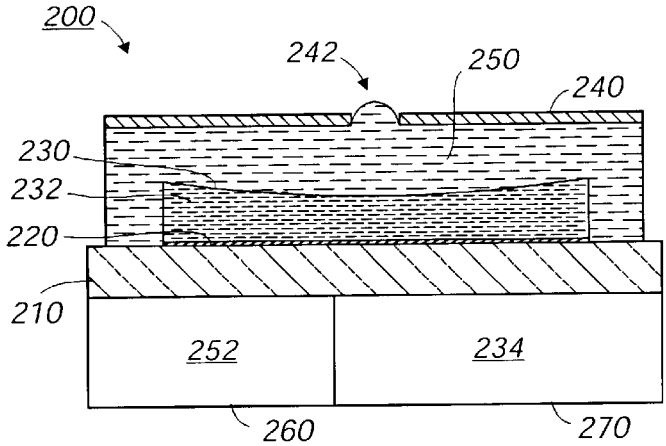
FIG. 5 is a cross-sectional view of the fluid ejector of FIG. 5 in a state where the diaphragm is ejecting a drop of fluid.
Figure 6:
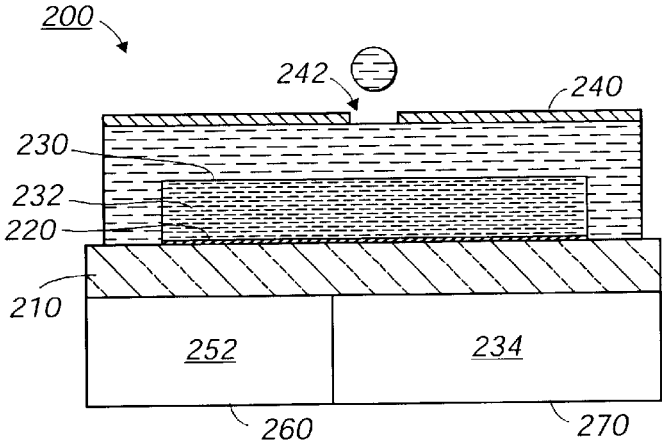
FIG. 6 is a cross-sectional view of the fluid ejector of FIG. 5 in a state where the diaphragm is at rest.
Figure 7:
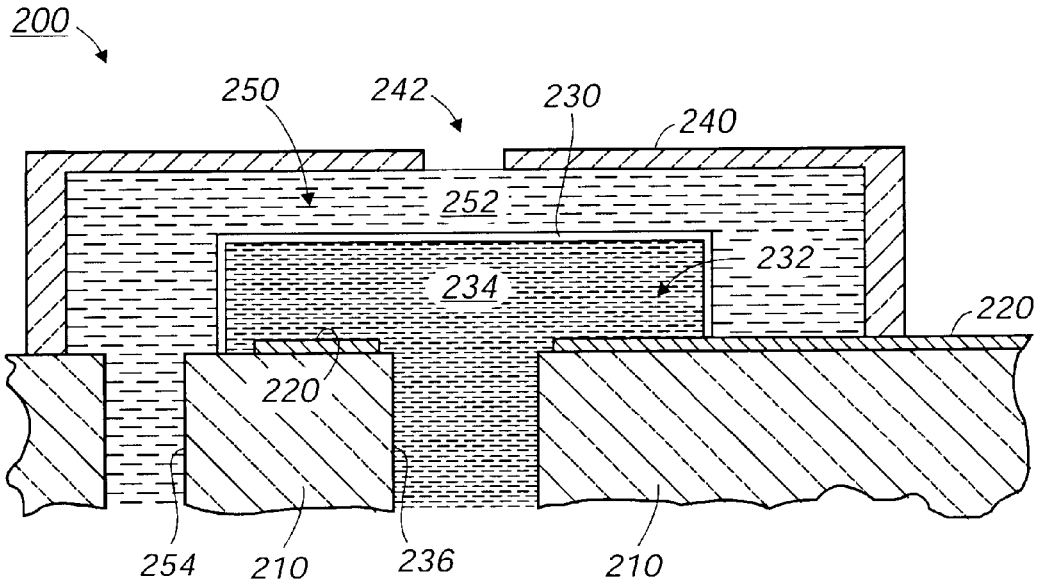
FIG. 7 is a cross-sectional view of the first exemplary embodiment illustrating the feed holes.

An ejection chamber 250 is defined between the faceplate 240 and the diaphragm portion 230. A fluid 252 to be ejected is supplied to the ejection chamber 250 of the fluid ejector 200 from a fluid reservoir, which may be located separate from the fluid ejector 200. As shown in FIGS. 4–6, a fluid reservoir 260 may be disposed on a side of the substrate 210 opposite the diaphragm portion 230. As shown in FIG. 7, an inlet hole 254 may be formed through the substrate 210 that leads to the fluid reservoir 260.

The secondary dielectric fluid 234 may be supplied from a secondary dielectric fluid reservoir 270, which may also be located separate from the fluid ejector 200. As shown in FIGS. 4–6, the secondary dielectric fluid reservoir 270 may be disposed on a side of the substrate 210 opposite the diaphragm portion 230. As shown in FIG. 7, a passageway 236 may be formed through the substrate 210 that leads to the secondary dielectric fluid reservoir 270.

The fluid ejector 200 operates on the principle of electrostatic attraction as illustrated in FIGS. 4–6. FIG. 4 shows an initial state and FIGS. 5–6 show a fluid drop being ejected. A drive signal is applied to the electrode 220 to generated an electrostatic field between the electrode 220 and the diaphragm portion 230. As shown in FIG. 5, an attractive electrostatic force causes the diaphragm portion 230 to deflect towards the electrode 220 into a deformed state. Upon deforming, the fluid 252 is drawn into the ejection chamber 250 to overfill the ejection chamber 250. A pressure is transmitted from the deflecting diaphragm portion 230 to the secondary dielectric fluid 234 causing the secondary dielectric fluid 234 to flow through the passageway 236 and into the secondary dielectric fluid reservoir 270. Thus, the electrostatic force need not overcome the incompressibilty of the secondary dielectric fluid 234 to deflect the diaphragm portion 230.

The drive signal is then removed from the electrode 220 so that the movement of the diaphragm portion 230 is reversed, either through resilient restoration actions of the deformed diaphragm portion 230 and/or through an applied force, to expel a drop of the fluid 252 through the nozzle hole 242. For example, although not shown, a second electrode may be associated with the faceplate 240 to apply a second electrostatic force to attract the diaphragm portion 230 in the opposite direction.

As previously described above with respect to the ejector 100 shown in FIGS. 1–3, the percentage of the fluid 252 that is expelled as a drop, relative to the amount of fluid being moved by the diaphragm portion 230, may be controlled through specific design parameters of the ejector 200. The parameters include the size of the diaphragm portion 230, the applied force(s), the distances between the diaphragm portion 230 and the faceplate 240 and other unique features that may help govern flow, such as, for example, incorporating valves into the ejector 200.

In various exemplary embodiments of the fluid ejection systems according to this invention, a high-performance dielectric fluid is used for the secondary dielectric fluid to enable significantly higher forces to be applied to the fluid. For example, distilled water has a dielectric constant, κ, of about 78. This means that a diaphragm structure may be designed to allow about 78 times the "spring" force to be applied to the fluid to be ejected as compared to an approach using air. Distilled water also has a very low conductivity, about $10^{-6}$ S/m, which enables low energy usage. Other dielectric fluids such as S-fluids, T-fluids, oils, organic solutions, etc. may be used. S-fluids and T-fluids are test fluids having the same composition as various inks such as, for example, dye-based aqueous inks, microemulsion inks, liquid crystalline inks, hot-melt inks, liposomic inks, and pigmented inks, without any colorants. Possible organic fluids include, for example, ethylene glycol, propanediol, diethylene glycol, glycerol, trihydroxypropane, butanediol, pentanediol and dimethyl sulfoxide. The design considerations for the secondary dielectric fluid include its dielectric constant, its wetting characteristics and its stability for electric field strength and applied voltage. Viscosity is also a consideration for the desired fluid flow with movement of the diaphragm.

Figure 8:
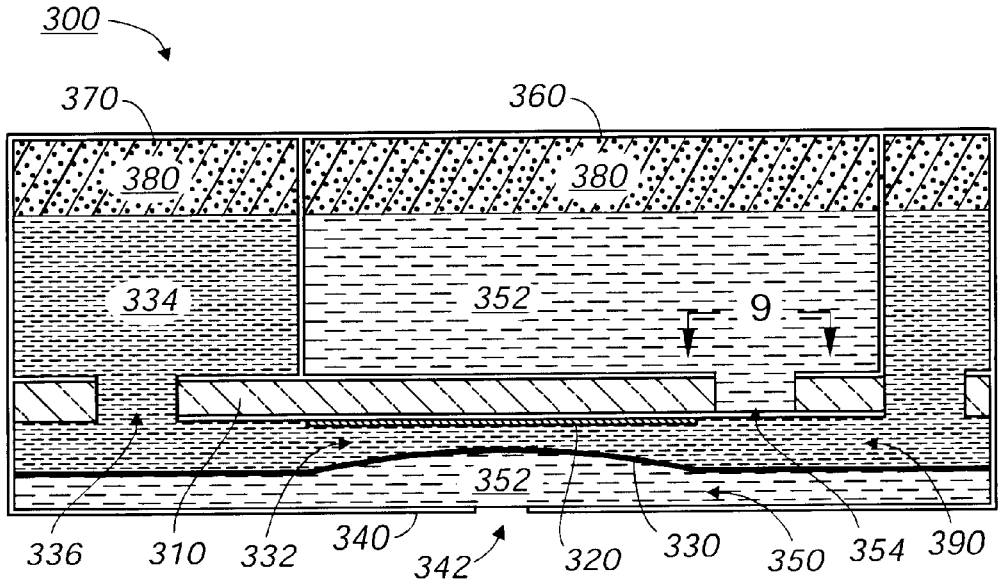
FIG. 8 is a cross-sectional view of a second exemplary embodiment of a fluid ejector according to this invention.

FIG. 8 shows a second exemplary embodiment of a fluid ejector 300 according to this invention. In the second exemplary embodiment, the fluid ejector 300 has a sealed diaphragm arrangement comprising a diaphragm portion 330 and a diaphragm chamber 332. The diaphragm chamber 332 contains a high-performance dielectric fluid 334.

In the exemplary embodiment shown in FIG. 8, the sealed diaphragm arrangement is formed on a substrate 310. An electrode 320 is situated on the substrate 310 opposite the diaphragm portion 330. A faceplate 340 with a nozzle hole 342 is situated on a side of the diaphragm portion 330 opposite the substrate 310.

An ejection chamber 350 is defined between the faceplate 340 and the diaphragm portion 330. A fluid 352 to be ejected is supplied to the ejection chamber 350 of the fluid ejector 300 from a fluid reservoir 360 formed on a side of the substrate 310 opposite the diaphragm portion 330. As shown in FIG. 8, an inlet hole 354 is formed through the substrate 310 that leads to the fluid reservoir 360.

The secondary dielectric fluid 334 is supplied from a secondary dielectric fluid reservoir 370 that is also formed on a side of the substrate 310 opposite the diaphragm portion 330. As shown in FIG. 8, a passageway 336 is formed through the substrate 310 that leads to the secondary dielectric fluid reservoir 370.

The fluid reservoir 360 and the secondary dielectric fluid reservoir 370 may include packing foam 380 that reduces "sloshing" and formation of bubbles in the respective fluids. The fluid reservoir 360 and the secondary dielectric fluid reservoir 370 may be sealed tanks and may be permanently attached to the substrate 310.

Figure 9:
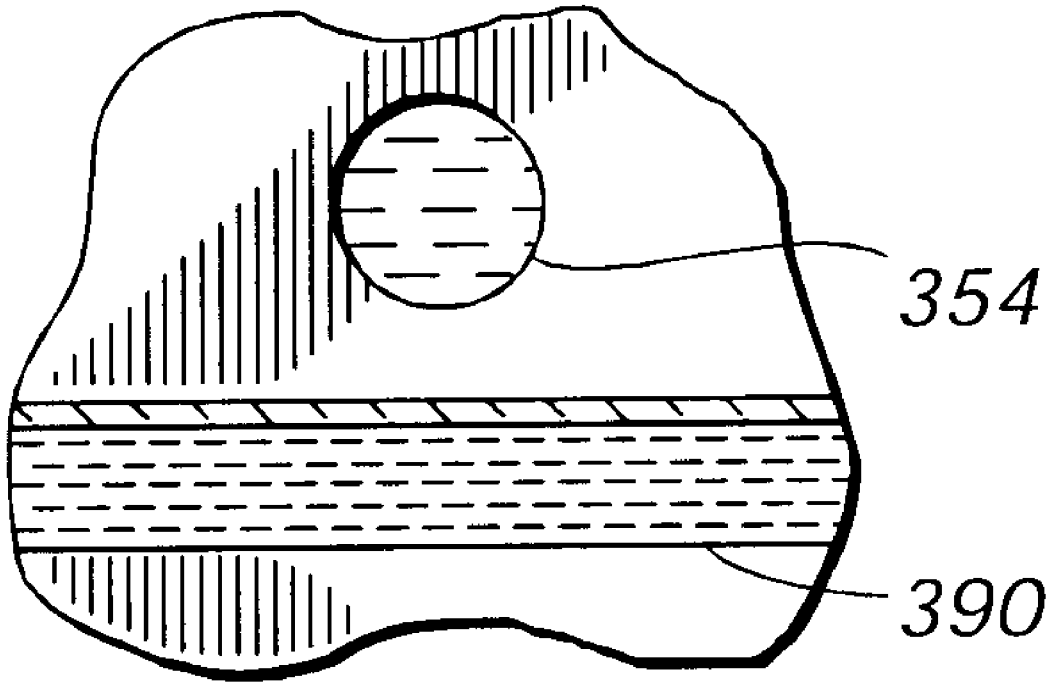
FIG. 9 is a partial plan view of the secondary embodiment shown in FIG. 8 illustrating the offset of the fluid inlet and the "burping" channel.

In the second exemplary embodiment, the fluid ejector 300 includes a "burping" channel 390 that allows the diaphragm chamber 332 to be completely filled with the secondary dielectric fluid 334. The channel 390 may be in fluid communication with atmosphere or with an overflow basin 392, which may be in fluid communication with atmosphere. As shown in FIG. 9 illustrating a partial plan view of the dashed circle in FIG. 8, the second exemplary embodiment has the "burping" channel 390 offset from the inlet hole 354 so that the fluid 352 can reach the ejection chamber 350 without interference.

As the diaphragm chamber 332 is supplied with the secondary dielectric fluid 334, any air in the diaphragm chamber 332 is purged or "burped" from the diaphragm chamber 332 through the channel 390. Some of the secondary dielectric fluid 334 may also be forced out of the diaphragm chamber 332 through the channel 390 to ensure that all of the air has been purged. The overflow basin 392 provides a convenient receptacle for the excess secondary dielectric fluid 334.

In an array of fluid ejectors, the fluid reservoir 360 and the secondary dielectric fluid reservoir 370 may be common to each of the fluid ejectors 300. Similarly, the "burping" channel 390 and the overflow basin 392 may be common to each of the fluid ejectors 300. Further, once the diaphragm chamber 332 is completely filled, the channel 390 may remain open or may be sealed.

The fluid ejector 300 operates as described above with respect to the first embodiment.

The inlet hole 354 and the passageway 336 may be formed through the substrate 310 using a modified Bosch etch. Such a method is disclosed in copending U.S. patent application Ser. No. 09/723,243, which is incorporated herein by reference in its entirety.

If needed, a modulated drive signal as disclosed in copending U.S. patent application Ser. No. 09/718,480, which is incorporated herein by reference in its entirety, may be used to increase dielectric fluid breakdown latitude. The essence of this approach is using a substantially constant electrostatic field throughout the "cocking" motion of the diaphragm. For fluids whose breakdown strength changes as the critical breakdown dimension change, the input drive signal may be suitably tailored to obtain substantially the maximum possible field strength. In more detail, to minimize the chance of electrical breakdown or other electrochemical reactions occurring within the dielectric fluid, the drive signal may be tailored to have certain specified characteristics. For example, the system may be driven at a suitably high frequency. Alternatively, or additionally, a bi-polar pulse train at the desired frequency may be used.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention. For example, the diaphragm may be configured as a bi-directional diaphragm as disclosed in copending U.S. patent application Ser. No. 09/718, 476, filed Nov. 24, 2000, which is incorporated herein by reference in its entirety.

What is claimed is:

1. A fluid ejection system, comprising:

a sealed diaphragm arrangement including at least one diaphragm portion and a diaphragm chamber defined at least partially by the at least one diaphragm portion;

a nozzle hole located proximate the at least one diaphragm portion;

an ejection chamber defined between the nozzle hole and the least one diaphragm portion, the ejection chamber receiving a primary fluid to be ejected; and a secondary dielectric fluid reservoir containing a secondary dielectric fluid, the secondary dielectric fluid reservoir being in fluid communication with the diaphragm chamber to supply the secondary dielectric fluid to the diaphragm chamber.

2. The fluid ejection system of claim 1, wherein the secondary dielectric fluid is a liquid.

3. The fluid ejection system of claim 1, wherein the secondary dielectric fluid is substantially incompressible.

4. The fluid ejection system of claim 1, wherein the secondary dielectric fluid is a high performance dielectric fluid having a dielectric constant greater than 1.

5. The fluid ejection system of claim 1, wherein the secondary dielectric fluid reservoir includes a foam insert.

6. The fluid ejection system of claim 1, wherein the secondary dielectric fluid reservoir is a vented tank.

7. The fluid ejection system of claim 1, further comprising:

a substrate that at least partially defines the diaphragm chamber; and a secondary dielectric feed hole formed through the substrate to communicate with the diaphragm chamber and the secondary dielectric fluid reservoir.

8. The fluid ejection system of claim 7, wherein the secondary dielectric fluid reservoir is disposed on a side of the substrate opposite the sealed diaphragm arrangement.

9. The fluid ejection system of claim 8, wherein the secondary dielectric fluid reservoir is fixedly connected to the substrate.

10. The fluid ejection system of claim 1, further comprising:

a secondary dielectric feed hole in fluid communication with the diaphragm chamber and the secondary dielectric fluid reservoir; and a channel in fluid communication with the diaphragm chamber, the channel being separate from the secondary dielectric feed hole.

11. The fluid ejection system of claim 10, further comprising an opening of the channel that is in communication with atmosphere.

12. The fluid ejection system of claim 10, further comprising an overflow basin that is in fluid communication with the channel.

13. The fluid ejection system of claim 12, wherein the overflow basin is in fluid communication with atmosphere.

14. A method for ejecting a fluid from a fluid ejector having a sealed diaphragm arrangement, comprising:

supplying a primary fluid to an ejection chamber of the fluid ejector;

supplying a secondary dielectric fluid to a diaphragm chamber of the sealed diaphragm arrangement from a secondary dielectric fluid reservoir;

moving a diaphragm of the sealed diaphragm arrangement to eject the primary fluid; and permitting movement of the secondary dielectric fluid between the diaphragm chamber and the secondary dielectric fluid reservoir to compensate for movement of the diaphragm.

15. The method of claim 14, wherein supplying the secondary dielectric fluid to the diaphragm chamber comprises completely filling the diaphragm chamber.

16. The method of claim 14, wherein supplying the secondary dielectric fluid to the diaphragm chamber comprises burping the diaphragm chamber.

* * * * *

UNITED STATES PATENT AND TRADEMARK OFFICE

CERTIFICATE OF CORRECTION

PATENT NO. : 6,406,130 B1
DATED : June 18, 2002
INVENTOR(S) : Gooray et al.

It is certified that error appears in the above-identified patent and that said Letters Patent is hereby corrected as shown below:

Column 1,
After the Title, please insert the following paragraph:

-- GOVERNMENT RIGHTS
This invention was made with Government support under Contract No. DE-AC04-94AL85000 awarded by the U.S. Department of Energy. The Government has certain rights in the invention. --

Signed and Sealed this

Third Day of December, 2002

JAMES E. ROGAN
*Director of the United States Patent and Trademark Office*